US006467316B1

(12) United States Patent
Chen

(10) Patent No.: US 6,467,316 B1
(45) Date of Patent: Oct. 22, 2002

(54) PROTECTIVE SLEEVE FOR A PADLOCK

(76) Inventor: Waterson Chen, 8F, No. 428, Wu-Chuan-Nan Rd., Taichung City (TW)

( * ) Notice: Subject to any disclaimer, the term of this patent is extended or adjusted under 35 U.S.C. 154(b) by 0 days.

(21) Appl. No.: 09/645,925

(22) Filed: Aug. 24, 2000

(51) Int. Cl.[7] ..... E05B 67/38

(52) U.S. Cl. ..... 70/56; 70/416; 70/423; 70/455

(58) Field of Search ..... 70/54–56, 416, 70/417, 423, 424, 427, 455

(56) References Cited

U.S. PATENT DOCUMENTS 1,662,612 A * 3/1928 Junkunc ..... 70/55
2,930,219 A * 3/1960 Fansmith ..... 70/54 X
4,218,902 A * 8/1980 Druschel ..... 70/55
4,286,445 A * 9/1981 Sills ..... 70/55
4,297,861 A * 11/1981 Dykes ..... 70/55
4,317,344 A * 3/1982 Barnard ..... 70/55
4,651,543 A * 3/1987 Heald et al. ..... 70/54
4,790,163 A * 12/1988 Appelbaum ..... 70/55 X
5,033,279 A * 7/1991 Lebrecht ..... 70/55
5,146,771 A * 9/1992 Laughlin ..... 70/56
5,156,029 A * 10/1992 Heald ..... 70/55
5,761,935 A * 6/1998 Adelmeyer ..... 70/55
6,178,787 B1 * 1/2001 Titterton ..... 70/33
6,192,721 B1 * 2/2001 Monteleone ..... 70/56 X

FOREIGN PATENT DOCUMENTS

GB 1365684 * 9/1974 ..... 70/54

* cited by examiner

*Primary Examiner*—Suzanne Dino Barrett
(74) *Attorney, Agent, or Firm*—Webb Ziesenheim Logsdon Orkin & Hanson, P.C.

(57) ABSTRACT

A protective sleeve for a padlock includes a sleeve body having an open inserting end adapted for insertion of a lock body of the padlock into the sleeve body, a restricting end opposite to the inserting end and adapted for abutting against the lock body, and a surrounding wall extending between the inserting end and the restricting end and adapted to wrap fittingly around the lock body. The sleeve body is formed with a key opening adapted to be aligned with a keyhole of the lock body. A cover flap is hinged to the sleeve body at the key opening, and is movable pivotally between an open position adapted for permitting access to the keyhole, and a closed position adapted for closing the keyhole. The cover flap is formed with a plug adapted to be inserted into the keyhole when the cover flap is moved to the closed position.

17 Claims, 10 Drawing Sheets

PROTECTIVE SLEEVE FOR A PADLOCK

BACKGROUND OF THE INVENTION

1. Field of the Invention

The present invention relates to a protective sleeve for a padlock, more particularly to a protective sleeve for protecting a lock body of a padlock from both impact and dust.

2. Description of the Related Art

A padlock generally includes a lock body and a shackle mounted on the lock body. The lock body is formed with a keyhole to permit insertion of a corresponding key thereinto for operating the shackle. However, as the keyhole is typically exposed from the lock body, dust, moisture and dirty water can enter into the lock body to adversely affect operation of the lock body, especially when the padlock has been in use for a long period of time. In addition, the lock body is typically installed with small components, such as springs and steel balls, therein. When the padlock is accidentally dropped on the ground, it is likely that the resulting impact can damage the components within the lock body and thus disable the padlock.

SUMMARY OF THE INVENTION

Therefore, the main object of the present invention is to provide a protective sleeve for protecting a lock body of a padlock from both impact and dust.

Accordingly, the protective sleeve of the present invention includes a sleeve body and a cover flap. The sleeve body has an open inserting end adapted to permit insertion of the lock body thereinto, a restricting end opposite to the inserting end and adapted for abutting against the lock body when the lock body is inserted into the sleeve body, and a surrounding wall extending between the inserting end and the restricting end and adapted to wrap fittingly around the lock body. The sleeve body is formed with a key opening adapted to be aligned with the keyhole of the lock body. The cover flap is hinged to the sleeve body at the key opening. The cover flap is movable pivotally between an open position adapted for permitting access to the keyhole of the lock body, and a closed position adapted for closing the keyhole of the lock body. The cover flap is formed with a plug which is adapted to be inserted into the keyhole when the cover flap is moved to the closed position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
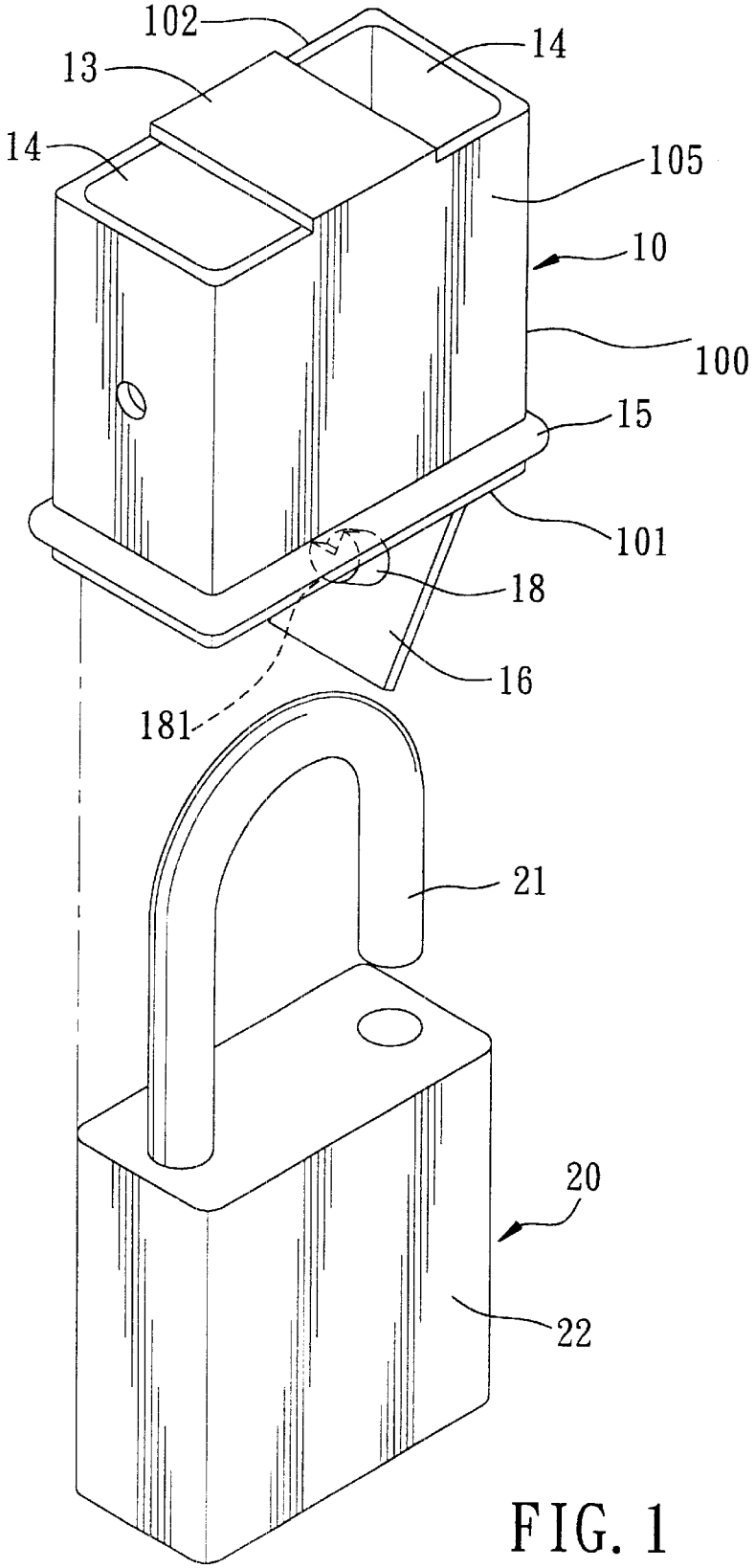
FIG. 1 is an exploded perspective view illustrating a first preferred embodiment of a protective sleeve of the present invention when applied to a first type of padlock with a U-shaped shackle.

Before the present invention is described in greater detail, it should be noted that like elements are denoted by the same reference numerals throughout the disclosure.

Figure 2:
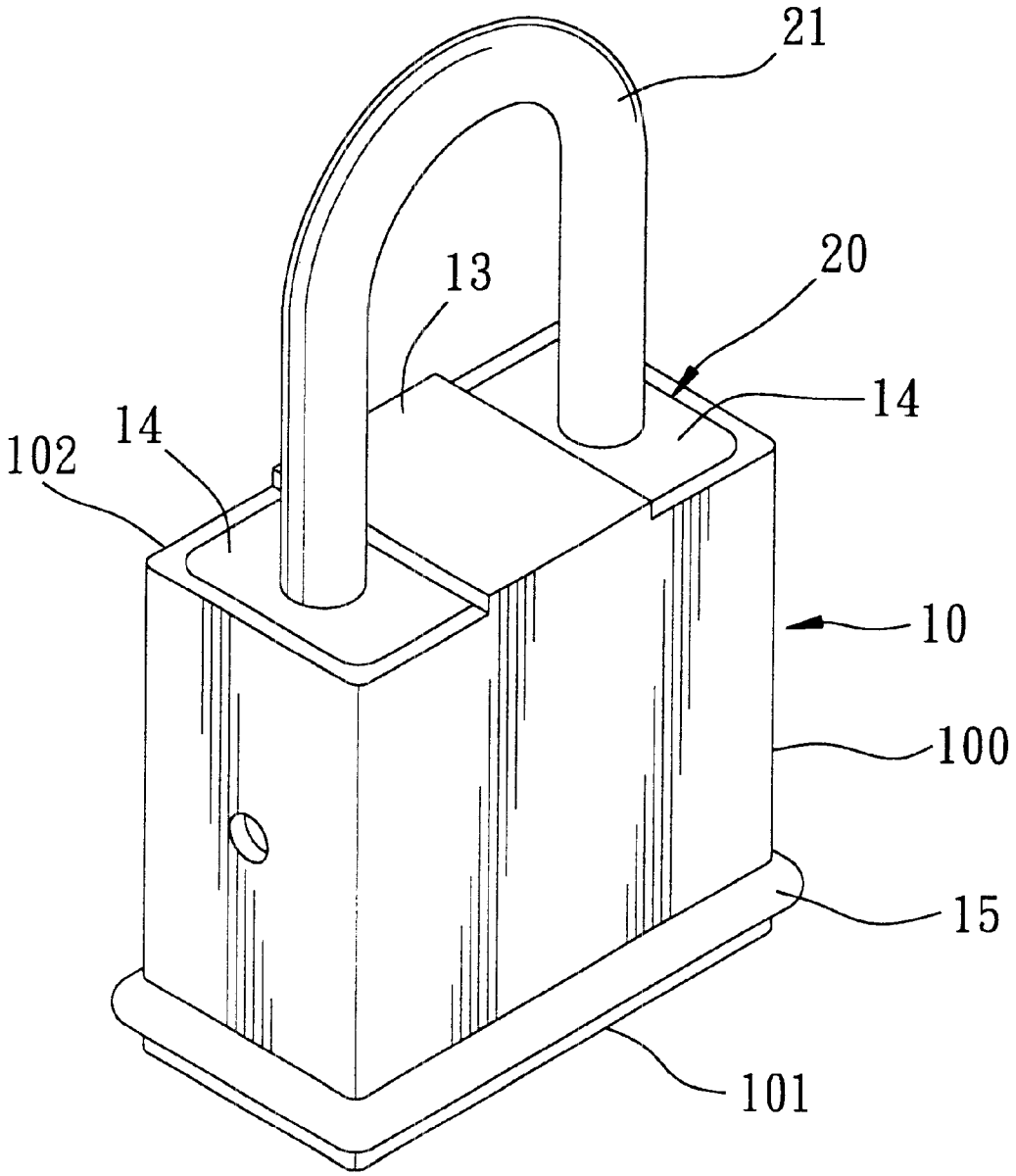
FIG. 2 is a perspective view of the first preferred embodiment when applied to the first type of padlock.

Referring to FIGS. 1 and 2, the first preferred embodiment of the protective sleeve 10 of the present invention is adapted to be applied to a padlock 20 of a first type having a lock body 22 which is formed with a keyhole 231 at a bottom end and which is mounted with a U-shaped shackle 21 at a top end. The protective sleeve 10 is shown to include a sleeve body 100, and a cover flap 16 formed integrally with the sleeve body 100 from a stretchable material, such as plastic.

The sleeve body 100 is formed as a hollow rectangular body, and confines a receiving space 11 adapted for receiving the lock body 22 of the padlock 20 therein. The sleeve body 100 has an open inserting end 101 adapted for insertion of the padlock 20 into the sleeve body 100 such that the keyhole 231 of the lock body 22 is disposed adjacent to the inserting end 101, a restricting end 102 opposite to the inserting end 101, and a surrounding wall 105 extending between the inserting end 101 and the restricting end 102. The inserting end 101 is formed with a key opening 12 (see FIG. 3) adapted to be disposed adjacent to and adapted to be aligned with the keyhole 231 of the lock body 22. In this embodiment, the restricting end 102 is an open end, and is formed with an abutment wall 13 adapted for abutting against the lock body 22 when the padlock 20 is inserted into the sleeve body 100. The abutment wall 13 also serves as a partition to define a pair of rectangular shackle holes 14 at the restricting end 102 and on opposite sides of the abutment wall 13 so as to permit extension of the U-shaped shackle 21 out of the sleeve body 100 and to permit engagement of the shackle 21 with the lock body 22. The surrounding wall 105 has an outer surface formed with a bumper strip 15 around the sleeve body 100 and proximate to the inserting end 101.

Figure 4:
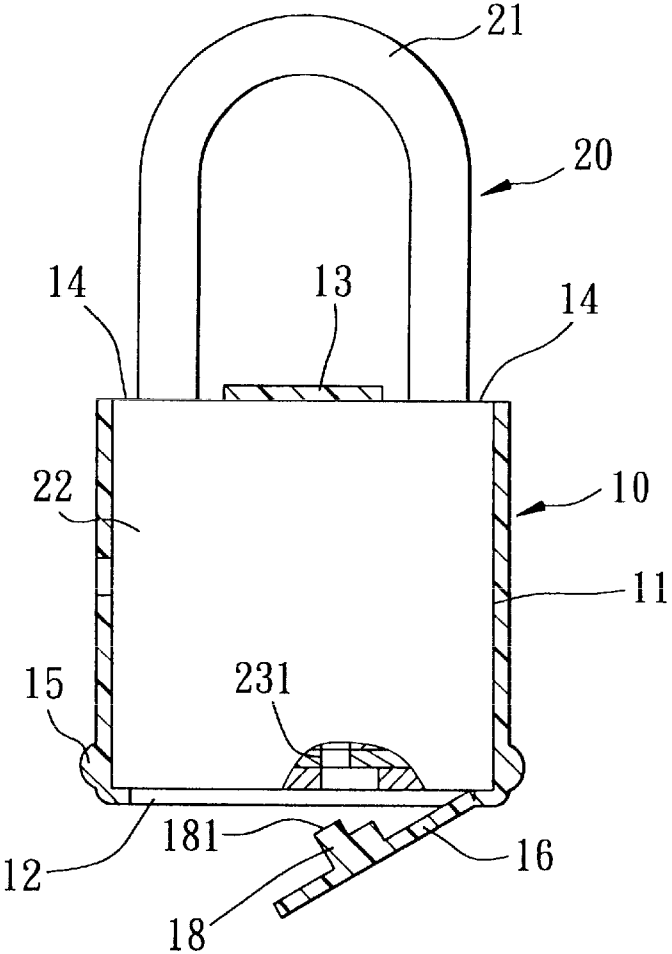
FIG. 4 is another cross-sectional view of the first preferred embodiment with the cover flap disposed in an open position.
Figure 3:
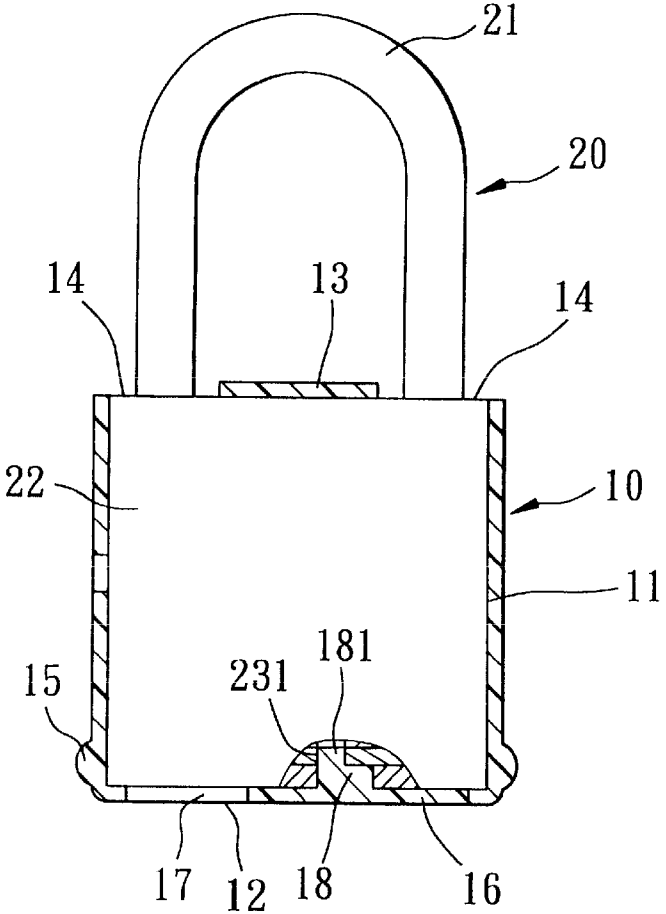
FIG. 3 is a cross-sectional view of the first preferred embodiment with a cover flap thereof disposed in a closed position.

Referring to FIGS. 3 and 4, the cover flap 16 is connected integrally and is hinged to the sleeve body 100 at the key opening 12. The cover flap 16 is movable pivotally between an open position adapted for permitting access to the keyhole 231, as shown in FIG. 4, and a closed position adapted for covering the keyhole 231, as shown in FIG. 3. The cover flap 16 is formed integrally with a plug 18 which has a cylindrical base portion connected to the flap 16 and a restricted distal end portion 181 having a cross-section formed as three quarters of a circle. The plug 18 is adapted to be inserted into the keyhole 231 in the lock body 22 when the cover flap 16 is moved to the closed position. The key opening 12 has a size larger than that of the cover flap 16 such that a finger hole portion 17 is formed adjacent to the cover flap 16 when the cover flap 16 is disposed at the closed position. The finger hole portion 17 permits extension of a finger of a person thereinto for moving the cover flap 16 to the open position.

Referring back to FIG. 1, when the protective sleeve 10 of the present embodiment is to be assembled to the padlock 20, the shackle 21 is disposed in an unlocking state, and is extended into the sleeve body 100 via the inserting end 101 and out of the sleeve body 100 via one of the shackle holes 14. The protective sleeve 10 is stretched during insertion of the padlock 20 thereinto.

Since the cover flap 16 is adapted for covering the keyhole 231, and since the plug 18 on the cover flap 16 is adapted to be inserted into the keyhole 231 when the cover flap 16 is moved to the closed position, dust, moisture, and dirty water can be prevented from entering into the lock body 22 to protect the same from damage. The bumper strip 15 further protects the lock body 22 from external impact when the padlock 20 is accidentally dropped on the ground.

Figure 5:
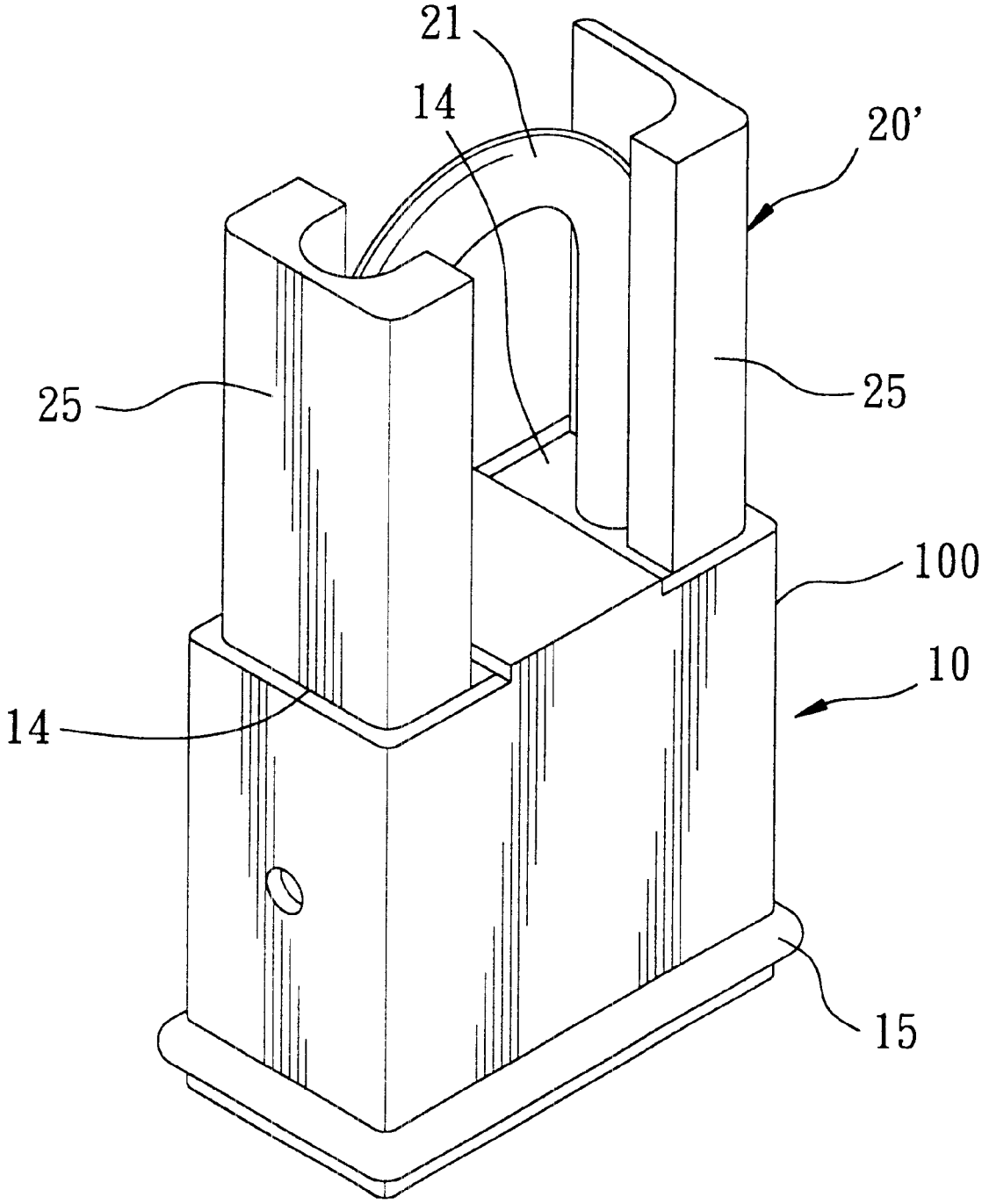
FIG. 5 is a perspective view of the first preferred embodiment when applied to a second type of padlock having a pair of shackle guards.

Referring to FIG. 5, the protective sleeve 10 of the present embodiment is adapted to be applied to a second type of padlock 20' which includes a pair of shackle guards 25 for enclosing the U-shaped shackle 21 when the shackle 21 is disposed in a locking state. The shackle guards 25 can extend out of the sleeve body 100 via the shackle holes 14.

Figure 6:
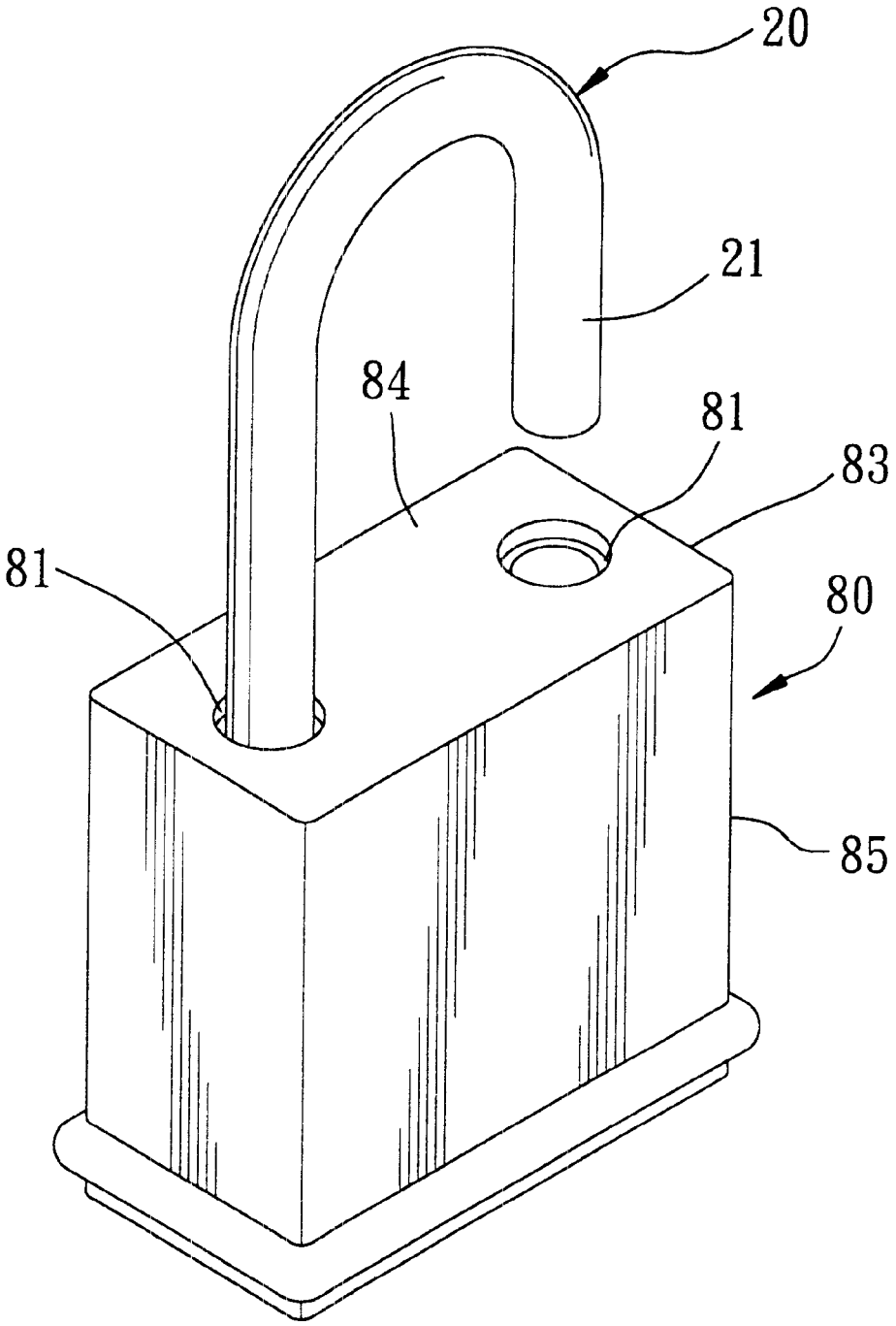
FIG. 6 is a perspective view of a second preferred embodiment of the protective sleeve of the present invention when applied to the first type of padlock.

FIG. 6 illustrates the second preferred embodiment of the protective sleeve 80 of the present invention when applied to the first type of padlock 20. The protective sleeve 80 is generally similar to the protective sleeve 10 in the previous embodiment, except that the restricting end 83 of the sleeve body 85 is covered by an end wall 84 which is formed with a pair of circular shackle holes 81 to permit extension of the U-shaped shackle 21 out of the sleeve body 85. Each of the shackle holes 81 has a size slightly larger than the cross-section of the U-shaped shackle 21. The shackle holes 81 shrink in cold weather for receiving more fittingly the shackle 21 therein so as to prevent entry of snow into the lock body.

Figure 7:
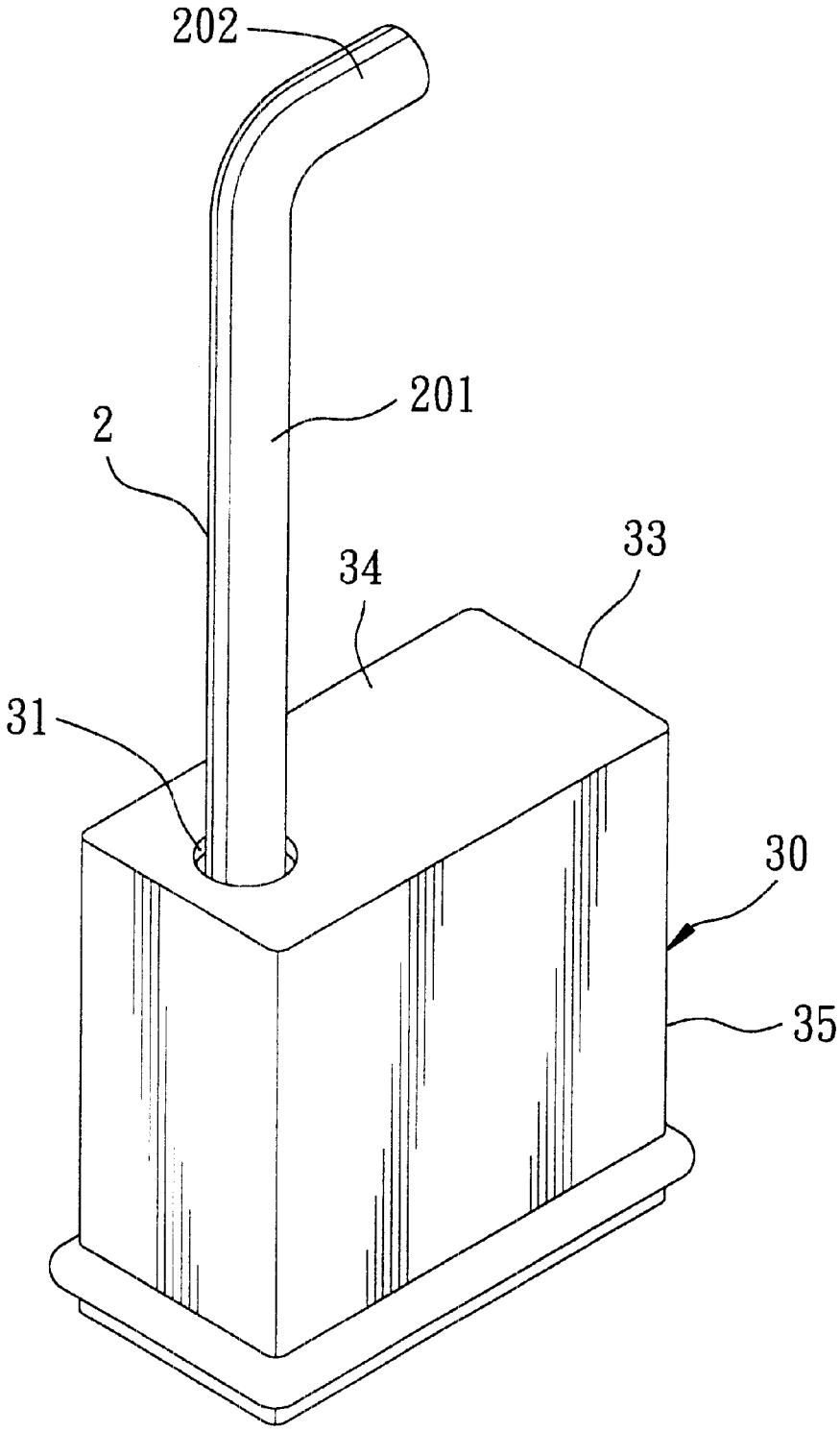
FIG. 7 is a perspective view of a third preferred embodiment of the protective sleeve of the present invention when applied to a third type of padlock having an L-shaped shackle.

FIG. 7 illustrates a third preferred embodiment of the protective sleeve 30 of the present invention when applied to a third type of padlock 2 which has a generally L-shaped shackle 201 with a bent end 202. The protective sleeve 30 is generally similar to the protective sleeve 80 of FIG. 6, except that the end wall 34 on the restricting end 33 of the sleeve body 35 is formed with only one circular shackle hole 31 to permit extension of the L-shaped shackle 201 out of the sleeve body 35.

Figure 8:
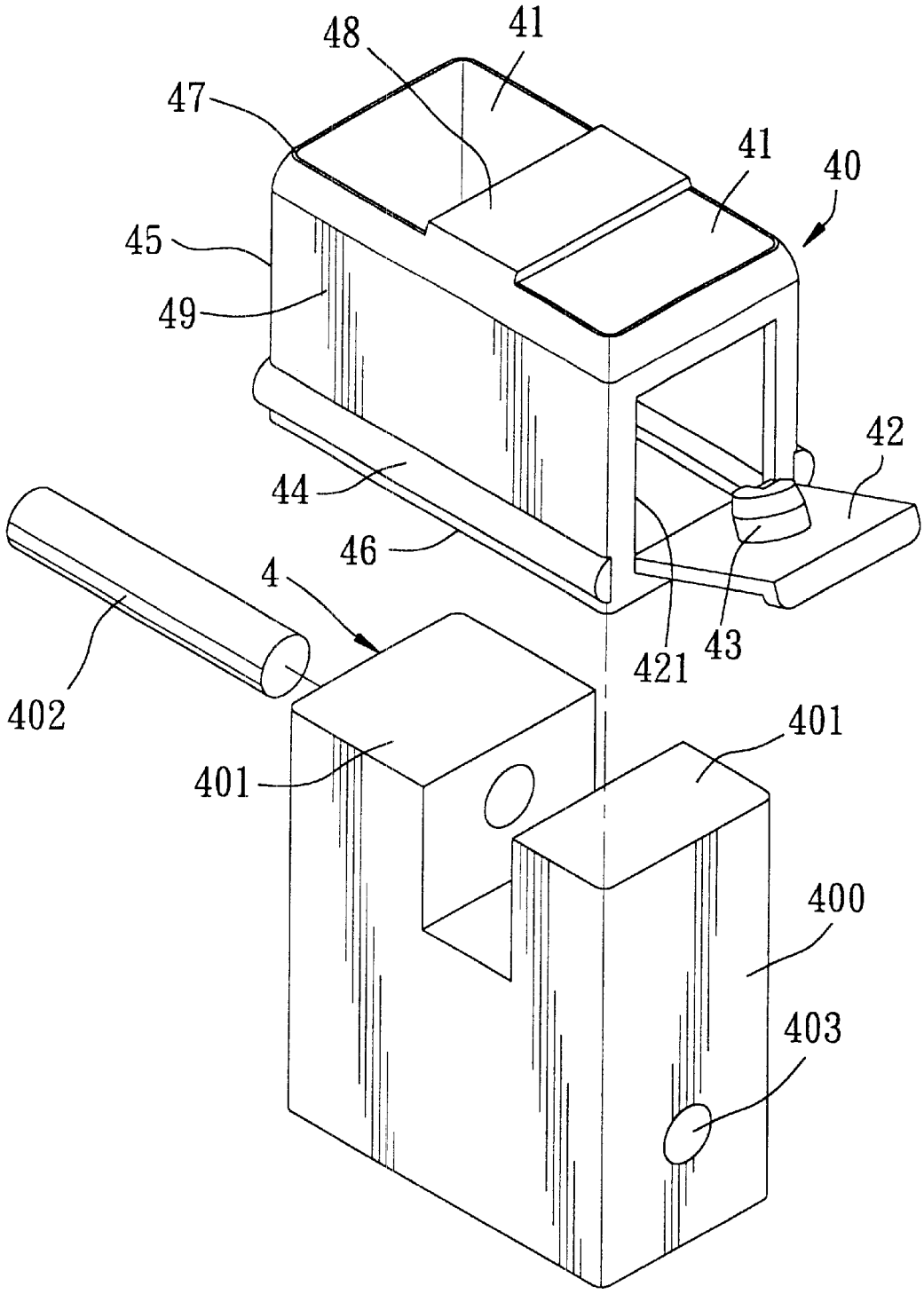
FIG. 8 is an exploded perspective view illustrating a fourth preferred embodiment of the protective sleeve of the present invention when applied to a fourth type of padlock having a U-shaped lock body.
Figure 9:
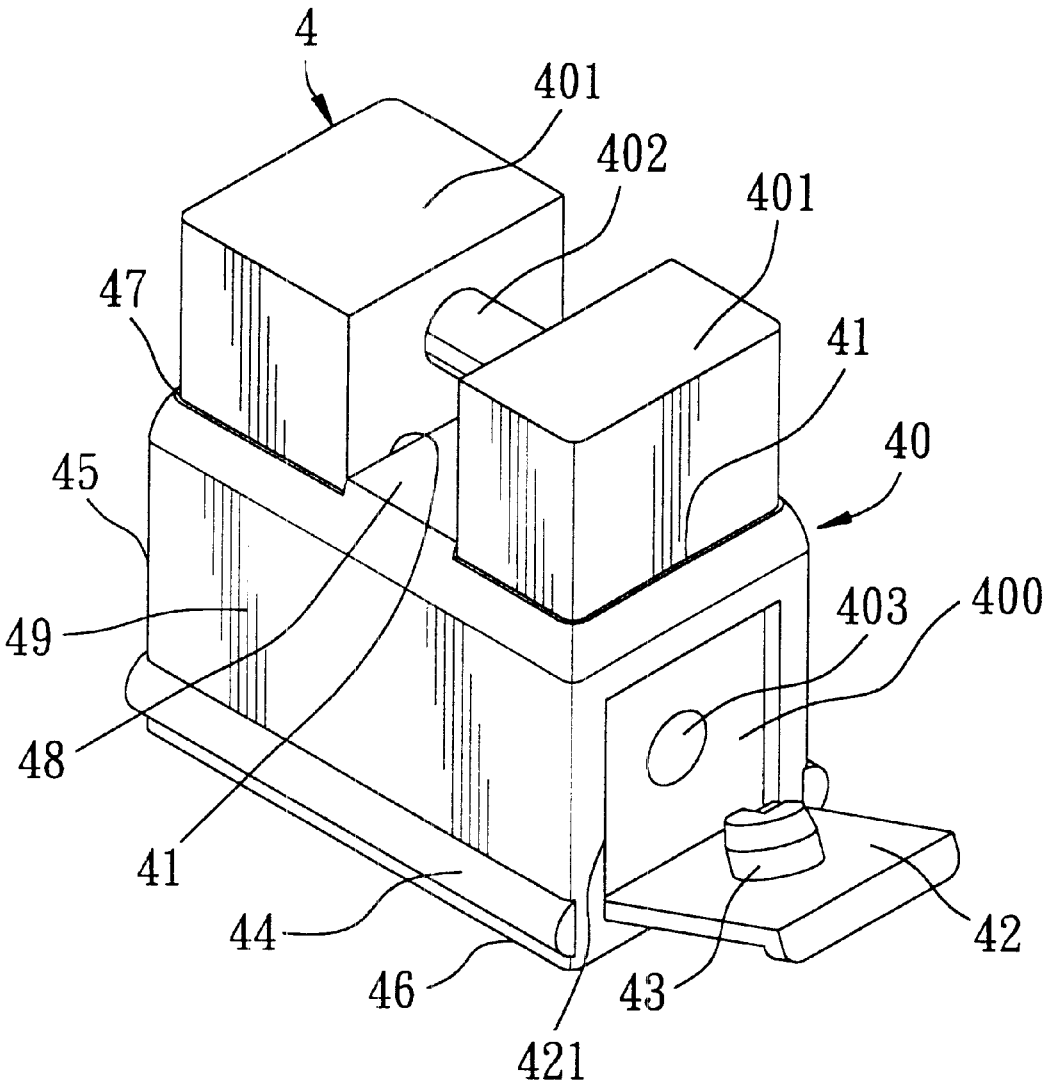
FIG. 9 is a perspective view of the fourth preferred embodiment when applied to the fourth type of padlock.

FIGS. 8 and 9 illustrate a fourth preferred embodiment of the protective sleeve 40 of the present invention when applied to a fourth type of padlock 4. The padlock 4 has a U-shaped lock body 400 formed with a keyhole 403 at a lateral end face, and a shackle 402 mounted on an upper end portion between a pair of upper body parts 401 of the U-shaped lock body 400. The protective sleeve 40 also includes a sleeve body 45 and a cover flap 42 formed integrally with the sleeve body 45 from a stretchable material, such as plastic.

The sleeve body 45 is formed as a hollow rectangular body adapted for receiving a lower body part of the U-shaped lock body 400 therein. The sleeve body 45 has an open inserting end 46 adapted to permit insertion of the padlock 4 into the sleeve body 45, a restricting end 47 opposite to the inserting end 46, and a surrounding wall 49 extending between the inserting end 46 and the restricting end 47 and adapted for wrapping fittingly around the lower body part of the lock body 400. In this embodiment, the restricting end 47 is an open end, and is formed with an abutment wall 48 which bridges the opening formed in the restricting end 47 and which is adapted for abutting against the lower body part of the lock body 400 when the padlock 4 is inserted into the sleeve body 45. The abutment wall 48 also serves as a partition to define a pair of rectangular top openings 41 at the restricting end 47 and on opposite sides of the abutment wall 48 so as to permit extension of the upper body parts 401 out of the sleeve body 45. The surrounding wall 49 is formed with a key opening 421 adapted to be disposed adjacent to and adapted to be aligned with the keyhole 403 of the lock body 400. The surrounding wall 49 has an outer surface formed with a bumper strip 44 which is proximate to the inserting end 46. The cover flap 42 is connected integrally and is hinged to the surrounding wall 49 at the key opening 421. The cover flap 42 is movable pivotally between an open position adapted for permitting access to the keyhole 403, and a closed position adapted for covering the keyhole 403. As with the foregoing embodiments, the cover flap 42 is formed integrally with a plug 43 that is adapted to be inserted into the keyhole 403 in the lock body 300 when the cover flap 42 is moved to the closed position.

When assembling the protective sleeve 40 of the present embodiment to the padlock 4, the shackle 402 is disposed in an unlocking state. The lock body 400 is then inserted into the sleeve body 45 via the inserting end 46 such that the keyhole 403 is aligned with the key opening 421 and such that the lower body part of the lock body 400 abuts against the abutment wall 48, thereby enabling the upper body parts 401 to extend out of the sleeve body 45 via the top openings 41, respectively.

Figure 10:
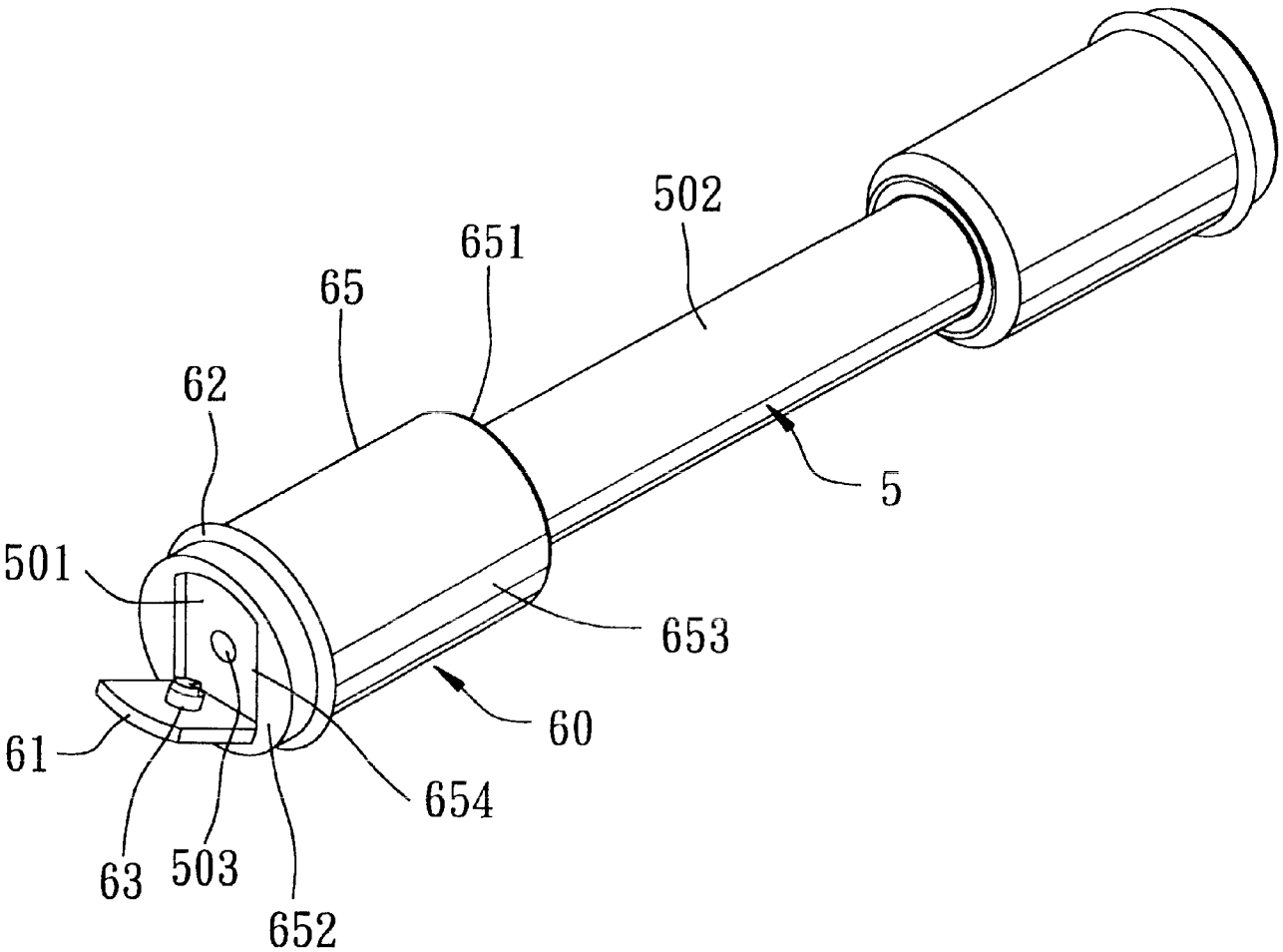
FIG. 10 is a perspective view of a fifth preferred embodiment of the protective sleeve of the present invention when applied to a fifth type of padlock having a cylindrical lock body.

FIG. 10 illustrates a fifth preferred embodiment of the protective sleeve 60 of the present invention when applied to a fifth type of padlock 5 which includes a cylindrical lock body 501 and an elongated shackle 502 mounted on the lock body 501. The lock body 501 has a first end formed with a keyhole 503, and an opposite second end mounted with the shackle 502. The protective sleeve 60 includes a sleeve body 65 and a cover flap 61 formed integrally with the sleeve body 65 from a stretchable material, such as plastic. The sleeve body 65 is formed as a hollow cylindrical body with an open inserting end 651 adapted to permit insertion of the lock body 501 of the padlock 5 into the sleeve body 65, a restricting end 652 opposite to the inserting end 651, and an annular surrounding wall 653 extending between the inserting end 651 and the restricting end 652 and adapted to wrap fittingly around the lock body 501. The restricting end 652 has an end wall which is adapted to abut against the lock body 501 and which is formed with a key opening 654 adapted to be aligned with the keyhole 503 in the lock body 501. The surrounding wall 653 has an outer surface formed with an annular bumper strip 62 around the sleeve body 65. The cover flap 61 is connected integrally and is hinged to the end wall of the restricting end 652 at the key opening 654. As with the previous embodiments, the cover flap 61 is formed integrally with a plug 63 which is adapted to be inserted into the keyhole 503 in the lock body 501 when the cover flap 61 is moved to its closed position for closing the key opening 654.

Figure 11:
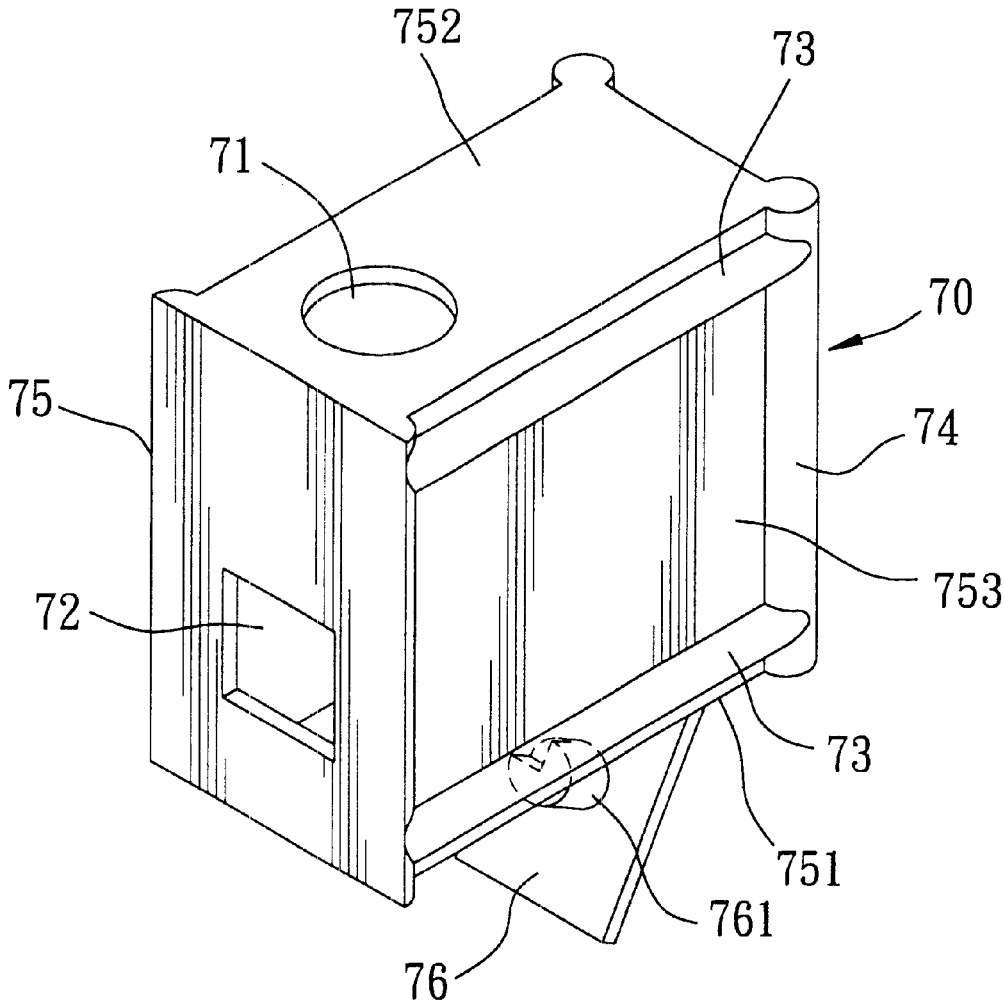
FIG. 11 is a perspective view of a sixth preferred embodiment of the protective sleeve of the present invention.

Referring to FIG. 11, a sixth preferred embodiment of the protective sleeve 70 of the present invention is shown to include a sleeve body 75 formed as a hollow rectangular body with an open inserting end 751, a restricting end 752 opposite to the inserting end 751, and a surrounding wall 753 extending between the inserting end 751 and the restricting end 752. The restricting end 752 has an end wall formed with a circular shackle hole 71. The surrounding wall 753 includes a lateral wall portion formed with a rectangular window opening 72, and a front wall portion formed with a pair of first bumper strips 73 on an outer surface thereof. The surrounding wall 753 is further formed with four second bumper strips 74 at its four corner edges, respectively. The second bumper strips 74 are transverse to the first bumper strips 73, and extend between the inserting end 751 and the restricting end 752. A cover flap 76 is hinged to the sleeve body 75 at the open inserting end 751, and is formed integrally with a plug 761.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A protective sleeve for a lock body of a padlock, the lock body having a first end formed with a keyhole and a second end with a shackle mounted thereon, said protective sleeve comprising:

a sleeve body having an open inserting end adapted to permit insertion of the lock body thereinto, a restricting end opposite to said inserting end and adapted for abutting against the lock body when the padlock is inserted into the sleeve body, and a surrounding wall extending between the inserting end and the restricting end and adapted to wrap fittingly around the lock body, said sleeve body being formed with a key opening adapted to be aligned with the keyhole of the lock body; and a cover flap hinged to said sleeve body at said key opening, said cover flap being movable pivotally between an open position adapted for permitting access to the keyhole of the lock body, and a closed position adapted for closing the keyhole of the lock body, said cover flap being formed with a plug which is adapted to be inserted into the keyhole when said cover flap is moved to the closed position.

2. The protective sleeve as claimed in claim 1, wherein said sleeve body and said cover flap are formed integrally from a stretchable material.

3. The protective sleeve as claimed in claim 2, wherein the stretchable material is plastic.

4. The protective sleeve as claimed in claim 1, wherein said key opening is disposed at said open inserting end, said restricting end being formed with an abutment wall adapted to abut against the lock body and a pair of shackle holes on opposite sides of said abutment wall and adapted to permit the shackle of the padlock to extend out of said sleeve body.

5. The protective sleeve as claimed in claim 4, wherein said key opening has a size larger than that of said cover flap such that said key opening has a finger hole portion formed adjacent to said cover flap when said cover flap is disposed at the closed position, said finger hole portion being adapted to permit extension of a finger thereinto for moving said cover flap to the open position.

6. The protective sleeve as claimed in claim 4, wherein said sleeve body is formed as a hollow rectangular body.

7. The protective sleeve as claimed in claim 1, wherein said key opening is disposed at said open inserting end, said restricting end having an end wall adapted to abut against the lock body, said end wall being formed with a shackle hole adapted to permit the shackle of the padlock to extend out of said sleeve body.

8. The protective sleeve as claimed in claim 7, wherein said sleeve body is formed as a hollow rectangular body.

9. The protective sleeve as claimed in claim 1, wherein said key opening is formed in said surrounding wall, said restricting end of said sleeve body being formed with an abutment wall adapted to abut against the lock body, and a pair of openings on opposite sides of said abutment wall and adapted to permit parts of the lock body to extend out of said sleeve body.

10. The protective sleeve as claimed in claim 9, wherein said sleeve body is formed as a hollow rectangular body.

11. The protective sleeve as claimed in claim 1, wherein said key opening is disposed at said restricting end.

12. The protective sleeve as claimed in claim 11, wherein said sleeve body is formed as a hollow cylindrical body.

13. The protective sleeve as claimed in claim 1, wherein said surrounding wall has an outer surface formed with at least one bumper strip.

14. The protective sleeve as claimed in claim 13, wherein said bumper strip extends around said surrounding wall.

15. The protective sleeve as claimed in claim 13, wherein said bumper strip extends between said inserting end and said restricting end.

16. The protective sleeve as claimed in claim 1, wherein the said plug of said cover flap has a cross-section formed as three-quarters of a circle.

17. A padlock and protective sleeve assembly, comprising:

a padlock having a lock body, the lock body having a first end formed with a keyhole and a second end with a shackle mounted thereon;

a protective sleeve, comprising:

a sleeve body having an open inserting end adapted to permit insertion of the lock body thereinto, a restricting end opposite to said inserting end and adapted for abutting against the lock body when the padlock is inserted into the sleeve body, and a surrounding wall extending between the inserting end and the restricting end and adapted to wrap fittingly around the lock body, said sleeve body being formed with a key opening adapted to be aligned with the keyhole of the lock body; and a cover flap hinged to said sleeve body at said key opening, said cover flap being movable pivotally between an open position adapted for permitting access to the keyhole of the lock body, and a closed position adapted for closing the keyhole of the lock body, said cover flap being formed with a plug which is adapted to be inserted into the keyhole when said cover flap is moved to the closed position.

* * * * *